United States Patent [19]

Monticolombi

[11] Patent Number: 4,832,347

[45] Date of Patent: May 23, 1989

[54] BOARD GAME

[76] Inventor: Carlo G. R. Monticolombi, 34 Otterburn Gardens, Isleworth, Middlesex, England

[21] Appl. No.: 135,319

[22] Filed: Dec. 21, 1987

[30] Foreign Application Priority Data

May 1, 1987 [GB] United Kingdom ..... 8710402

[51] Int. Cl.[4] ..... A63F 3/00

[52] U.S. Cl. ..... 273/248; 273/142 R

[58] Field of Search ..... 273/274, 287, 273, 280, 273/248, 142 JC, 142 JD, 243, 142 R, 142 JA

[56] References Cited

U.S. PATENT DOCUMENTS 2,720,399 10/1955 Pattyn ..... 273/142 JC
3,759,521 9/1973 Breslow et al. ..... 273/243
3,936,054 2/1976 Garcia ..... 273/243

FOREIGN PATENT DOCUMENTS 2354 12/1892 United Kingdom ..... 273/249

*Primary Examiner*—Edward M. Coven
*Assistant Examiner*—Benjamin Layno
*Attorney, Agent, or Firm*—Parmelee, Miller, Welsh & Kratz

[57] ABSTRACT

A board game comprises a board defining an enclosed track of adjacent spaces. A spinner positioned at the center of the board has elements which randomly identify at least one of the spaces by pointing to the spaces. The game further comprises a plurality of playing pieces to be moved from space to space by players, and a pair of dice to indicate the number of spaces the playing pieces can be moved. According to the rules, if a spinner element randomly points to a space occupied by a playing piece, that playing piece may be removed from the board.

11 Claims, 1 Drawing Sheet

BOARD GAME

A claim of priority benefits is made based upon United Kingdom patent application No. 8710402 filed May 1, 1987.

BACKGROUND OF THE INVENTION

The present invention relates to a board game.

BRIEF SUMMARY OF THE INVENTION

According to this invention there is provided a board game, said board game comprising a board, the board defining a track of adjacent spaces to be occupied by playing pieces, and including means in the form of a spinner to identify, in a random manner, at least one of the playing spaces, the game further comprising a plurality of playing pieces to be moved from space to space by players, and a random number generator to indicate the number of spaces the playing pieces can be moved.

Preferably said track is in the form of substantially circular track, and the spinner is located in the centre of the track.

Conveniently the spinner is adapted to identify two playing spaces substantially diametrically opposed.

Advantageously the spinner is in the form of a base plate carrying a vertically upstanding element on which is rotatably supported a rotatable element carrying means identifying the space or spaces.

Preferably the space identifying means comprise representations of two gunmen.

Conveniently the playing pieces comprise a plurality of components representing Mafia soldiers, and a plurality of components representing "Godfathers" for each player.

Preferably the components for each player are of a respective colour.

Conveniently selected playing spaces carry indicia indicating items of significance to the game to be played.

Preferably the random number generator comprises a pair of dice.

BRIEF INTRODUCTION TO THE DRAWINGS

DESCRIPTION OF PREFERRED EMBODIMENT

Figure 1:
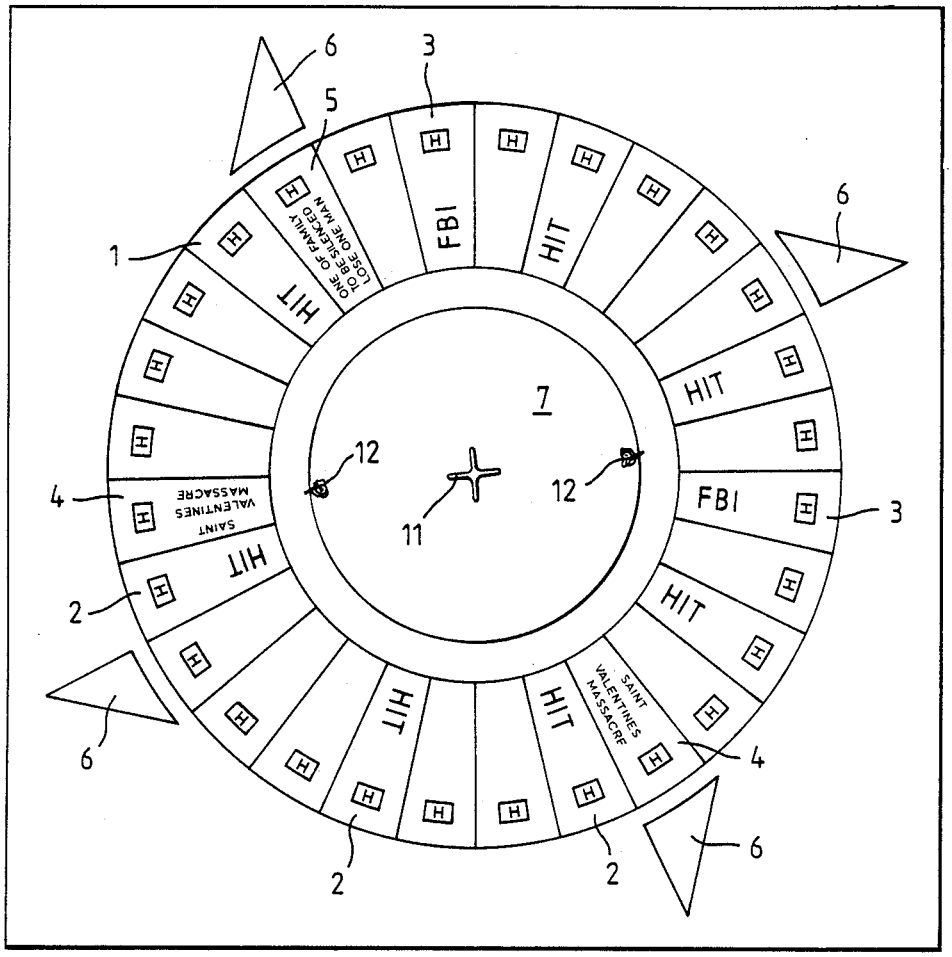
FIG. 1 is a plan view of a board for playing a game in accordance with the invention.

Referring to the drawings the board defines a substantially circular track 1 consisting of a plurality of adjacent spaces. The various spaces carry markings providing those spaces with particular significance. For example, various spaces 2 are marked with the word "Hit", various spaces 3 are marked with the letters "F.B.I.", and various spaces 4 are marked "St. Valentine's Massacre". At least one space 5 is marked "One of family to be silenced, lose one man".

Located adjacent the circular track 1 are four equally-angularly spaced spaces, which are four base or "home" regions 6.

Figure 2:
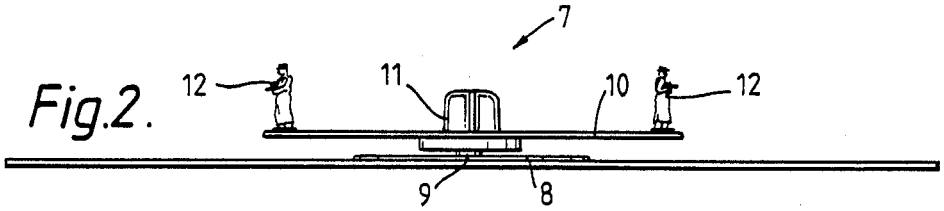
FIG. 2 is a side view of the board.

Located in the cent e of the circular track is a spinner arrangement 7. As can be seen most clearly in FIG. 2 the spinner arrangement 7 consists of a base 8 having an upstanding pin 9. Mounted on the pin 9 is a spinner plate 10 which has a central inverted thimble 11 which actually rests on top of the pin 9. The plate 10 carries two elements 12 each representing a gunman, carrying guns pointing radially outwardly. The elements 12 are at diametrically opposed positions and it is to be understood that these representations provide an indication of two spaces present on the track 1 which are diametrically opposed.

The plate 10 may be spun, in which case the plate will rotate and will stop indicating a random pair of playing spaces on the track 1.

Figure 3:
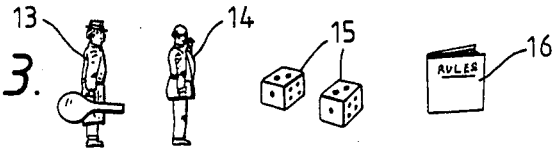
FIG. 3 is a view showing the remaining components of the game.

Turning now to FIG. 3 the equipment to play the game comprises a plurality of playing elements 13, each representing Mafia soldiers. These playing pieces may conveniently be formed of four different colours if the game is to be played, as intended, by four players. Also the game comprises four playing pieces 14, representing four "Godfathers" and again these playing pieces will be made of the four different colours. Additionally the game comprises two dice 15, and a rule book 16.

The game is based on the theme of the "Mafia" and at the beginning of the game each player is provided with a "Godfather" 14 and a number of Mafia soldiers 13, for example, eight Mafia soldiers which form a family. Each player will have playing pieces of one respective colour. Also each player is allocated one "Home" space 6 where he initially locates his playing pieces.

The general idea of the game is for each player to make his Godfather complete one circuit of the track 1 and return to the home base without the Godfather being killed.

The game commences with the players each throwing the dice, the player with the highest score commencing.

On each throw of the dice a player may move either one playing piece by number of spaces equal to the total number of spots showing on the dice or may move one playing piece by a number of spaces as indicated by the spots on one die and another playing piece a number of spaces as shown by the spots on the other die. As will become apparent from the following description it is desirable for the Godfather, whenever he is on the circular track 1 to be protected, if at all possible, by at least one Mafia soldier 13 being on the same space. Thus, as the game commences, it is envisaged that players will initially locate some Mafia soldiers on the track 1 before bringing the Godfather onto the track 1.

If a player causes any one of his playing pieces to land on one of the squares 2 marked with the word "Hit" that player is allowed to spin the spinner arrangement 7. The gunman on the spinner arrangement will, when the spinning has finished, indicate two diametrically opposed spaces. If there is a Mafia soldier on either of the spaces indicated then that Mafia soldier is deemed to be killed and is eliminated from the game. If there are two Mafia soldiers 13 of the same player occupying one space, only one Mafia soldier 13 is eliminated from the game. If there is a Mafia soldier 13 and a Godfather 14 on one player on the square, the soldier is eliminated, but the Godfather survives. If the Godfather is alone on the square, unprotected, then the Godfather is eliminated.

If the spinning arrangement 7 identifies a square 4 marked with the words "St. Valentine's Massacre" all soldiers present on the square will be eliminated. If the Godfather is also present on the square, that is to say if the Godfather is present on the square together with soldiers, then the Godfather will not be eliminated.

It will be understood, therefore, that players will endeavour to have at least one Mafia soldier 13 present on any square occupied by the Godfather 14 so that if a "Hit" should occur there will be no chance of the Godfather being eliminated. However, from time-to-time it will be inevitable that the Godfather 14 of one or more players will be in a playing space on his own. If there is then a "Hit" and the gunman 12 on the spinning arrangement 7 identifies a square occupied by the Godfather, then the Godfather is eliminated and that particular player is out of the game.

If one of the Mafia soldiers 13 of one player is alone on a space, and an opponent is able to move one of his Mafia soldiers 13 onto that same space, the Mafia soldier 13 of the first player will be deemed to be taken hostage. The Mafia soldier of the first player cannot then move. If another of the Mafia soldiers of the opponent lands on the space, so there are two soldiers of the opponent, the Mafia soldier of the first player is deemed to be "Hit" and is therefore eliminated from the game.

The Godfather can be held hostage in this manner, but cannot be eliminated in this manner. If, when a "Hit" occurs, a gunman 12 identifies space containing a Mafia soldier or the Godfather of one player, being held hostage by the Mafia soldier of another player, the hostage is deemed to be eliminated, but his captor survives, unless the "Hit" stem from a move of the first player, in which case, the captor is eliminated and the hostage survives.

Only three playing pieces from the same player are allowed on one playing space at a time. In the event of two players of one family being on one space, no other player can land a playing piece on that space.

The Godfather playing pieces 14 are not allowed to land on the spaces 3 marked "F.B.I.". If any playing piece lands on the spaces marked "One of the family to be silenced, lose one man" that player loses a Mafia soldier 13.

Each player must move at least one playing piece if they can. Thus if there is a possible move, or combination of moves, that can be made subsequent to the throwing of the dice, that move or combination of moves must be made. If, at the end of the move or moves a player has been found to move a playing piece onto a "Hit" space 2, then the spinning arrangement 7 is spun.

Any Mafia soldier 13 who completes a full circle of the track, can reclaim a Mafia soldier 13 previously eliminated from the game (if there are any).

It is to be understood that the Godfather, when approaching his "Home" base 6 can only be moved to that Home base if the number of spots shown on the dice permit him to move precisely to the Home base 6. If the dice are unkind, and if a large number of Mafia soldiers 13 have been eliminated from the game, it may be that the number shown on the dice is such that the Godfather must be moved past the home base 6, in which case the Godfather must complete a further circuit of the track 1 before he can enter his home base 6. However, if the Godfather does start a second circuit of the track 1 he collects three of his previously eliminated Mafia soldiers 13.

In a modified version of the game the spinner is adapted to emit a sound similar to that of machine gun fire when the spinner is spun. This may be achieved by providing the spinner with a noise generating device such as that used in a rattle thus the fixed base may be provided with an element with a discontinuous surface, such as an element resembling a cog wheel, and the rotary part of the spinner may carry one or more elements biassed resiliently into contact with the discontinuous surface, so that, as the spinner spins, the resiliently biassed element moves rapidly into contact with sequential parts of the discontinuous surface. However, many other techniques may be used to obtain the desired effect.

What is claimed is:

1. A board game, said board comprising a board, the board defining a substantially circular track of adjacent spaces to be occupied by playing pieces, and including means in the form of a spinner located in the center of the track to identify, in a random manner, at least one of the playing spaces, the game further comprising a plurality of playing pieces to be moved from space to space by players, and a random number generator separate from said spinner to indicate the number of spaces the playing pieces can be moved.

2. A board game according to claim 1 wherein the spinner is adapted to identify two playing spaces substantially diametrically opposed.

3. A board game according to claim 1 wherein the spinner is in the form of a base plate carrying a vertically upstanding element on which is rotatably supported a rotatable element carrying means identifying the space or spaces.

4. A board game according to claim 3 wherein the space identifying means comprise representations of two gunmen.

5. A board game according to claim 1 wherein the spinner, when operated, emits a sound resembling that of gunfire.

6. A board game according to claim 1 wherein the playing pieces comprise a plurality of components representing Mafia soldiers, and a plurality of components representing "Godfathers" for each player.

7. A board game according to claim 6 wherein the components for each player are of a respective colour.

8. A board game according to claim 1 wherein selected playing spaces carry indicia indicating items of significance to the game to be played.

9. A game according to claim 1 wherein the random number generator comprises a pair of dice.

10. A board game, said board game comprising a board, the board defining a single, continuous track of adjacent spaces to be occupied by playing pieces, and including means in the form of a spinner to identify, in a random manner, at least one of the playing spaces along said track, the game further comprising a plurality of playing pieces to be moved from space to space by players, and a random number generator separate from said spinner to indicate the number of spaces the playing pieces can be moved.

11. A board game, said board game comprising a board, the board defining a single, continuous track of adjacent spaces to be occupied by playing pieces, and including means in the form of a spinner adapted to identify, in a random manner, two playing spaces substantially diametrically opposed upon said track, the game further comprising a plurality of playing pieces to be moved from space to space by players, and a random number generator separate from said spinner to indicate the number of spaces the playing pieces can be moved.

* * * * *